US011725164B1

(12) United States Patent
Grant et al.

(10) Patent No.: US 11,725,164 B1
(45) Date of Patent: Aug. 15, 2023

(54) BIOBASED CLEANING COMPOSITIONS AND METHODS OF PREPARATION THEREOF

(71) Applicant: Kraton Chemical, LLC, Jacksonville, FL (US)

(72) Inventors: Stephanie Grant, Houston, TX (US); David Germack, Houston, TX (US); Brett Neumann, Savannah, GA (US)

(73) Assignee: KRATON CORPORATION, Houston, TX (US)

( * ) Notice: Subject to any disclaimer, the term of this patent is extended or adjusted under 35 U.S.C. 154(b) by 0 days.

(21) Appl. No.: 17/929,323

(22) Filed: Sep. 2, 2022

Related U.S. Application Data

(60) Provisional application No. 63/260,991, filed on Sep. 8, 2021.

(51) Int. Cl.
*C11D 9/00* (2006.01)
*C11D 15/04* (2006.01)

(52) U.S. Cl.
CPC ..... *C11D 9/00* (2013.01); *C11D 15/04* (2013.01)

(58) Field of Classification Search
None
See application file for complete search history.

(56) References Cited

U.S. PATENT DOCUMENTS

| | | | | |
|---|---|---|---|---|
| 3,618,707 | A * | 11/1971 | Sluhan | B23Q 11/1069 184/6.14 |
| 5,565,134 | A * | 10/1996 | Tanner | C11D 9/26 530/220 |
| 2009/0209690 | A1* | 8/2009 | Sandstrom | B60C 1/0025 152/209.1 |
| 2011/0197915 | A1 | 8/2011 | Frenkel et al. | |
| 2012/0149623 | A1 | 6/2012 | Li et al. | |
| 2021/0189132 | A1 | 6/2021 | Van Herrikhuyzen et al. | |

* cited by examiner

*Primary Examiner* — Necholus Ogden, Jr.

(57) ABSTRACT

A cleaning composition is disclosed comprising a method of cleaning a substrate to remove a residue from the substrate by using a cleaning composition comprising (a) a decarboxylated rosin acid (DCR), and (b) optionally a diluent. The residue is selected from soil, dirt, sand, food, oil, grease, paint, ink, glue, adhesive, sealant, wax, tar, graffiti, asphalt, buffing compounds, cutting fluids, and mixtures thereof. At least 0.3 wt.% of the residue is removed from the substrate per cleaning cycle, based on total weight of the residue present on the substrate. The cleaning composition is stable and is effective in removing the residue from hard or soft substrates.

20 Claims, 1 Drawing Sheet

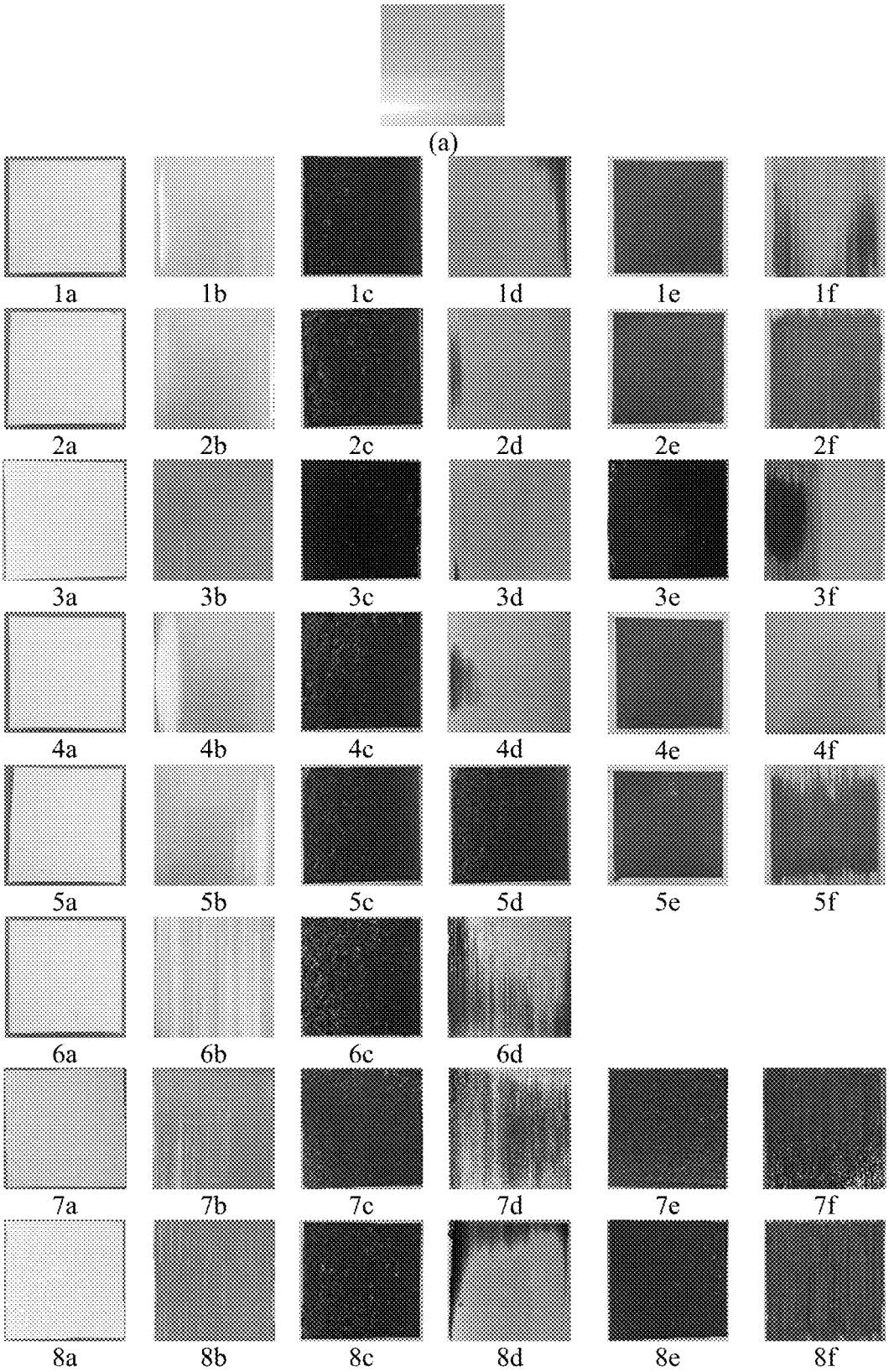
(a)
1a
1b
1c
1d
1e
1f
2a
2b
2c
2d
2e
2f
3a
3b
3c
3d
3e
3f
4a
4b
4c
4d
4e
4f
5a
5b
5c
5d
5e
5f
6a
6b
6c
6d
7a
7b
7c
7d
7e
7f
8a
8b
8c
8d
8e
8f

BIOBASED CLEANING COMPOSITIONS AND METHODS OF PREPARATION THEREOF

RELATED APPLICATIONS

This application claims benefit to U.S. provisional application No. 63/260,991, filed on Sep. 8, 2021, which is hereby incorporated herein by reference.

FIELD

The disclosure relates to methods of cleaning substrates with biobased cleaning compositions, and applications thereof.

BACKGROUND

Cleaning is often required in places such as industries, houses, transportations, hospitals, garages, etc., where heavy oils, greases, dirt, grime, asphalts, and other unwanted material are deposited. Cleaning if not done immediately leaves stains which are difficult to remove. Conventional cleaning agents include petroleum derived or halogenated hydrocarbon solvents with high levels of strong alkaline agents such as caustic, phosphates, etc. These cleaning agents are not environmentally friendly to use, or disposal can be restricted.

It is desirable to have cleaning compositions from renewable resources, and which are effective in cleaning compared with fossil-based cleaning agents. A rosin is a biobased material which can be modified for applications including cleaning.

There is a need for a method to effectively clean a substrate with a cleaning composition based on a bio-source. The cleaning composition exhibits improved cleaning performance and has a high flashpoint and a low volatile organic contents (VOCs).

SUMMARY

In one aspect, the disclosure relates to a method of cleaning a substrate to at least partially remove a residue from the substrate, comprising, consisting essentially of, or consists of: contacting at least a portion of the residue on the substrate with a cleaning composition. The cleaning composition comprises (a) a decarboxylated rosin acid (DCR) having a density of 0.9-1.0 g/cm$^3$, a flash point of 135-175° C., an acid value of <50 mg KOH/g, measured according to ASTM D465, and a viscosity of 15-60 cSt at 40° C., measured according to ASTM D-445; and (b) optionally a diluent; and removing at least a portion of the cleaning composition along with at least a portion of the residue from the substrate. The residue is selected from the group consisting of soil, dirt, sand, food, oil, grease, paint, ink, glue, adhesive, sealant, wax, tar, graffiti, asphalt, buffing compounds, cutting fluids, fat, sludge, and mixtures thereof. At least 0.3 wt.% of the residue, or at least 0.5-20 wt.% of the residue is removed from the substrate per cleaning cycle, based on total weight of the residue present on the substrate, measured as described in a Scrub Test.

In a second aspect, the DCR comprises: one or more C=C groups; and 40 to 100 wt.% of tricyclic compounds having 18 to 20 carbon atoms, based on total weight of the DCR.

In a third aspect, the sum of tricyclic compounds as aromatic and cycloaliphatic in the DCR is >50 wt.%, based on total weight of the DCR.

In a fourth aspect, an amount of the tricyclic cycloaliphatic compound in the DCR is >15 wt.%, based on total weight of the DCR.

In a fifth aspect, the diluent is selected from the group consisting of water, aliphatic hydrocarbons, aromatic hydrocarbons, alcohols, natural oil solvents, fats and oils, fatty acids, glycerin, and mixtures thereof.

DRAWINGS

FIG. 1 presents photographs of substrates with residues before and after cleaning with cleaning compositions by the Scrub Test.

DESCRIPTION

The following terms will be used throughout the specification.

"Cleaning" refers to a method of removing a residue or unwanted substances, such as dirt, grease, oil, infectious agents, and other impurities from a substrate.

"Diluent" or "carrier" refers to a liquid medium in which substances are dispersed, suspended, dissolved, or partially dissolved in.

"Solubility Parameter" or (δ) of a solvent or polymer, refers to the square root of the vaporization energy (ΔE) divided by its molar volume (V), as in the equation $\delta=(\Delta E/V)^{1/2}$. The more similar the solubility parameters of two substances, the higher will be the solubility between them and hence the expression "like dissolves like." Hansen established that the solubility parameter of a solvent or polymer is the result of the contribution of three types of interactions: dispersion forces ($\delta_D^2$), polar interactions ($\delta_P^2$), and hydrogen bonds ($\delta_H^2$) (Hansen, 2007; Hansen, 1967), with the total solubility (Hildebrand) parameter δT as the result of contribution of each of the three Hansen solubility parameters (HSP) according to: $\delta_T=(\delta^2_D+\delta^2_P+\delta^2_H)^{1/2}$.

"Scrub Test" or "Grease Removal Test" refers to the following test: First, grease is applied to a 3×6 inches steel coupon and grease applied to a size of 2.5×2.5×0.3 inches or 1×4×0.3 inches. Tare weight of the coupon, and the amount of grease applied, is recorded. The coupon with grease is baked at 160° C. for 15 hrs. and cooled down to a room temperature in an oven. Next, 10 ml of a cleaning composition is applied to a cellulose sponge. Grease is then removed from the coupon by using the cellulose sponge containing the cleaning composition. Thereafter, the coupon is air dried and weighed to compute weight removal as a percentage.

The disclosure relates to a method of cleaning a substrate to remove a residue by using a cleaning composition comprising: (a) a decarboxylated rosin acid (DCR), and (b) a diluent. The cleaning composition is stable, effective in removing the residue, has a low flashpoint, and low volatile organic contents (VOCs).

Decarboxylated Rosin Acid (DCR): The DCR is a rosin-derived composition obtained by decarboxylating a rosin acid, or by dimerizing and decarboxylating a rosin acid and separating/removing the dimerized species. The DCR is in the form of a liquid, and can be any of a crude DCR, a distilled or purified DCR, or mixtures thereof. The DCR can be hydrogenated and/or functionalized. Crude DCR is DCR containing 5-25 wt.% of higher molecular weight (450-1500 Da) components, e.g., hydrocarbons, oligomers, polymers, impurities, or dimer/trimer of fatty acids. Distilled or purified DCR refers to crude DCR having heavy fractions removed to improve color, reduce sulfur, etc.

DCR is produced by the decomposition of rosin acids at high temperatures, e.g., 220-300° C. Rosin acids are normally solid, having a softening point of, e.g., 65-85° C. The rosin acid can be fully decarboxylated forming DCR. The rosin acid can be partially decarboxylated, forming DCR, which is a mixture of molecules, some of which contain monocarboxylic acids having a general molecular formula, e.g., $C_{20}H_{30}O_2$.

In embodiments, the DCR comprises one or more C=C groups, 40-100 wt.% of tricyclic compounds having 18-20 carbon atoms, 0-30 wt.% of components with <19 carbon atoms, and 40-100 wt.% of components with a molecular formula in the range from $C_{19}H_{20}$ to $C_{19}H_{34}$, based on total weight of the DCR.

In embodiments, the DCR is characterized as having a m/z (mass/charge) value in the range of 220-280, or 230-270, or 234-262, or 235-265, or >230, or <265, measured by GC-FID-MS.

In embodiments, the DCR is characterized as having an oxygen content of <5%, or <3%, or <2%, or 0-1%. The oxygen content (in %) can be calculated as oxygen to carbon ratio, or the sum of oxygen atoms present divided by sum of carbon atoms present, with the number of oxygen and carbon atoms being obtained from elemental analyses.

In embodiments, sum of tricyclic compounds as aromatic and cycloaliphatic in the DCR is >50, or >55, or >60, or >74, or >90, or up to 100 wt.%, of total weight of the DCR. Aromatic DCR is defined as DCR species having a MW of 252-256 g/mol, with MW of 254 g/mol as having a reactive double bond, and cycloaliphatic DCR is defined as DCR species having a MW of 260 or 262 g/mol.

In embodiments, an amount of the tricyclic cycloaliphatic compound is >15, or >20, or >30, or >40, or >50, or >80 wt.%, based on total weight of the DCR.

In embodiments, total amount of tricyclic compounds having reactive double bond (C=C group) is 1-45, or <40, or <30, or <20, or <15, or <10 wt.% of total weight of the DCR. Reactive C=C group is defined as DCR species having a MW of 254 or 258 g/mol.

In embodiments, the DCR is characterized as having a lower acid value (carboxylic acid content) than the rosin acid feedstock for making the DCR. In embodiments, the DCR has an acid value of <50, or <45, or <40, or <35, or <30, or <25, or <20, or <15, or <10, or <7, or <5, or 0.5-40, or 0.5-30, or 0.5-20, or 1-20, or 1-15, or 1-15, 1-10 mg/KOH, as measured using ASTM D1240-14 (2018) or ASTM D465.

In embodiments, the DCR has a density of 0.9-1.0, or 0.91-0.99, or 0.92-0.98, or 0.93-0.97, or 0.94-0.96, or >0.9, or <1.1 g/cm$^3$.

In embodiments, the DCR is characterized as having viscosities comparable to those of petrochemical base oils, due in part to its relatively high molecular weights, for example, a viscosity of 15-60, 18-55, 20-50, or 22-48, or 25-45, or 28-42, or 30-40, or >20, or >25, or >28, or <45, or <50 cSt, according to ASTM D-445, measured at 40° C.

In embodiments, the DCR has an aniline point of 3-40° C., or 5 - 40° C., or 5-30° C. , or 5-25° C., or 2-20° C., or 5-20° C., or 5-15° C., or <25° C., or <20° C., or >3° C. , or >5° C., or >8° C., measured according to ASTM D611.

In embodiments, the DCR has a pour point of −40 to +10° C., or −35 to +8° C., −30 to +5° C., or −30 to +0° C., or −30 to −5° C., or −28 to 0° C. or −28 to −5° C., or −28 to −10° C., or >−30° C., or >−28° C., or <+5° C., measured according to ASTM D97.

In embodiments, the DCR has a flash point of 135-175° C., 135-165° C., or 135-160° C., or 140-175° C., or 140-160° C., or 140-158° C., or 140-155° C., or >135° C., or >140° C., or <175° C., or <165° C., or <160° C., measured according to ASTM D92.

In embodiments, the DCR has a boiling point of 200-390° C., or 210-390° C., or 235-390° C., 280-380° C., or 290-370° C., 300-360° C., or >290° C., or >230° C., >210° C., or <400° C., or <370° C., measured according to D2887.

In embodiments, the DCR has a Gardner Color of 0-12.0, or 0.5-12.0, or 0.8-12.0, or 0.9-11, or 1.0-10.0, or 1.0-6.0, or 1.0-5, or >0, or >1.0, or >1.2, or <10.0, or <7.0, or <6.0, or <5.0, or <2.4, or <3.0, measured according to ASTM D6166.

In embodiments, the DCR has a sulfur content of <500 ppm (0.05 wt.%), or <300 ppm (0.03 wt.%), or <200 ppm (0.02 wt.%), or <100 ppm (0.01 wt.%), or <10 ppm (0.001 wt.%), or 20-700 ppm (0.002-0.7 wt.%), 30-500 ppm (0.003-0.5 wt.%), or 40-400 ppm (0.004-0.4 wt.%), or 40-300 ppm (0.004-0.3 wt.%), or 40-200 ppm (0.004-0.2 wt.%), based on total weight of the DCR, measured according to ASTM D5453.

In embodiments, the DCR has a VOC of <5, or <4.75, or <4.5, or <4.25, or <4.0, or <3.75, or <3.5, or <3.25, or <3.0, or <2.75, or <2.5, or <2.25, or <2.0, or <1.5, or <1.0, or <0.5 wt.%, based on total weight of the DCR. The VOC of the DCR is measured according to methods: i) summing the percent by weight contribution from all VOCs present in the product at 0.01% or more, or ii) according to the EPA (Environmental Protection Agency) method 24 or equivalent.

In embodiments, the DCR has a Kb (Kauri butanol) value of 25-90, or 30-85, or 35-80, or 40-75, or 45-70, or 50-65, or >40, or >50, or >60, or >70, or >80, measured according to ASTM D1133.

In embodiments, the DCR has a viscosity index of <−100, or <−110, or <−115, or <−120, measured according to ASTM D2270. The viscosity index is an arbitrary, unit-less measure of a fluid's change in viscosity relative to temperature change, for example, index of viscosity at 40° C. and viscosity at 100° C.

In embodiments, the DCR has a δD value of 14-18, or 14.2-17.8, or 14.5-17.5, or 15-17, or 15.2-16.5; a δP value of 3-6, or 3.2-5.5, or 3.4-5.2, or 3.5-5.0; and δH value of 7-10, or 7.5-9.5, or 8-9, or 8.2-8.8.

In embodiments, the DCR has a surface tension of 25-50, or 28-45, or 30-40 dynes/cm, measured according to ASTM D1331.

In embodiments, the cleaning composition consists essentially of DCR, e.g., up to 100 wt.%. In embodiments, the cleaning composition comprises DCR in amounts of 1-20, or 2-15, or 5-10, or 1-5, or 1-10, or 5-20 wt.%, based on total weight of the cleaning composition.

Diluent: In embodiments, the diluent is selected from the group consisting of water, aliphatic hydrocarbons, aromatic hydrocarbons, alcohols, natural oil solvents, fats and oils, fatty acids, glycerin, commercially available shampoos, and mixtures thereof Non-limiting examples of diluents include dimethoxymethane, acetone, octanol, nonanal, decanal, linalool, soybean oil, methanol, ethanol, isopropanol, 2-butoxyethanol, alcohols from $C_6$ to $C_{22}$, terpenes, pinene, tall oil methyl ester, linseed oil methyl and lower alkyl esters, turpentine, eucalyptus oil, peppermint oil, tung oil, esters derived from tung oil, or lower alkyl esters with a natural oil based additive, and mixtures thereof In embodiments, the diluent is water, e.g., deionized (DI) water, tap water, running water, city water, municipal water, or mixtures thereof.

In embodiment, the diluent is present in amounts of 0-99, or 80-99, or 85-98, 75-99, or 90-95, or 95-99, or 90-99, or 80-95 wt.%, based on total weight of the cleaning composition.

Optional Additives: Additives if present, include but are not limited to silica, wax, metallic soaps, surfactants, unsaponifiable materials, freezing point suppressants, chelating agents, cloud point suppressants, diluents, stabilizers, rheology modifiers, metal stearates, biocides, preservatives, extreme pressure (EP) additives, anti-wear additives, corrosion inhibitors, metal deactivators, deodorants, antioxidants, dyes, colorants, pigments, wetting agents, viscosifiers, polymers, resins, plasticizers, redox couples, fillers, fibers, flame retardants, viscosity modifiers, deaerators, heat stabilizers, light stabilizers, drip retardants, anti-blocking agents, anti-static agents, flow-promoting agents, processing aids, pH control agents, builders, fragrance, essential oils, buffer systems, solubilizers, abrasive powder, anti-microbial agents, anti-redeposition agents, water softeners, borax, emollients, anti-freeze additives, alkylene glycol dilevulinate, digestive enzymes, enzyme stabilizers, boosters (e.g., alkalinity agents), a detectable component for assessing the cleaning of the substrate (e.g., color indicator, etc.), scrubbing agents, and mixtures thereof.

In embodiments, the surfactant is selected from the group consisting of conventional anionic, cationic, non-ionic, amphoteric surfactants, and mixtures thereof. Non-limiting examples of surfactants include compounds derived by esterification of lipid having a carbon number of 16 or higher, said surfactant having a hydrophilic-lipophilic balance (HLB)>6; surfactants comprising at least one of a methoxylated vegetable oil and an ethoxylated vegetable oil, the ethoxylated vegetable oil having a HLB>6 and an average degree of ethoxylation>1; sodium linear alkylbenzene sulfonates; alkyl sulfates; alpha olefin sulfonates; acyl sarcosinates; sodium salt of coconut fatty acids; sulfonated alkyl esters; alkyl polyglucosides; primary alcohol ethoxylates; alkyl polypentasides; secondary alcohol ethoxylates; ethylene oxide (EO-PO) and propylene oxide (EO-BO) block polymers; sodium 3-dodecylamino-propionate; dodecylbenzenesulfonic acid and the sodium; potassium; ethanolamine; lauryl alcohol ethoxylate; morpholinium; ammonium and isopropylamine salts thereof morpholinium tallate; and mixtures thereof.

The pH control agent can be selected from but not limited to potassium chloride, potassium acetate, potassium carbonate, potassium lignite, potassium hydroxide, potassium salt of partially hydrolyzed polyacrylamide (PHPA), sodium chloride, calcium chloride, sodium hydroxide, calcium oxide, calcium hydroxide, magnesium oxide, sodium carbonate, and the like.

Non-limiting examples of the abrasive powder contain pumice, calcium carbonate (limestone, chalk, dolomite), kaolinite, quartz, soapstone, sodium silicate, talc, and mixtures thereof.

In embodiments, the cleaning composition further comprises an anti-redeposition agent to help prevent soil/grease from resettling on the substrate after removal. Examples of anti-redeposition agents include but are not limited to carboxymethyl cellulose (CMC), hydroxypropyl methylcellulose (HPMC), polyvinyl acetate, polyvinylpyrrolidone, poly-4-vinylpyridine-N-oxide (PVnO), polyvinyl alcohol, and mixtures thereof.

Non-limiting examples of builders include sodium carbonate, calcium carbonate, calcium chloride, magnesium carbonate, ethylenediaminetetraacetic acid (EDTA), nitriloacetic acid (NTA), borates, zeolites, alkyl or hydroxyalkyl cellulose derivatives, and mixtures thereof In embodiments, optional additive is present in amounts of up to 20, or 0.5-15, or 1-12, or 3-10, or 1-10, or 1-5 wt.%, based on total weight of the cleaning composition.

Method of Preparation of Cleaning Composition: In embodiments, the cleaning composition comprises (a) DCR, and (b) optionally diluent; or alternatively, 1-20 wt.% of DCR, and 80-99 wt.% of diluent; or alternatively 1-10 wt.% of DCR, 75-99 wt.% of diluent, and 1-15 wt.% of surfactant, based on total weight of the cleaning composition.

The cleaning composition can be an aqueous or a non-aqueous liquid composition, prepared by known methods, such as by mixing of all the components by stirring with static mixers, or by high shearing forces in colloid mills, dissolvers, and rotor-stator homogenizers. In embodiments, the cleaning composition is in a liquid form as a continuous phase or a discontinuous phase, e.g., as suspension, dispersion, emulsion, solution, or sol.

Properties of Cleaning Composition: The cleaning composition can be used at ambient temperature to remove residues from substrates. The composition is environmentally friendly, exhibit improved cleaning performance, having suitable viscosity for cleaning application.

In embodiments with water as the diluent, the cleaning composition has a pH in the range of 9-13, or 9.5-12.5, or 10-12.

In embodiments, the cleaning composition removes at least 0.3 wt.% of the residue from the substrate, or >0.5, or >1, or >2, or >5, or 0.3-30, or 0.5-20, or 1-15, or 1-10 wt.%, based on total weight of the residue present on the substrate, measured according to ASTM D4488-95-A5.

In embodiments, the cleaning composition removes at least 0.3 wt.% of the residue from the substrate per cleaning cycle, or >0.5, or >1, or >2, or >5, or 0.3-30, or 0.5-20, or 1-15, or 1-10 wt.%, based on total weight of the residue present on the substrate. One cleaning cycle is defined as back and forth gentle wiping of the substrate containing the cleaning composition and the residue with an object, e.g., a cellulose sponge.

In embodiments, the cleaning composition has a biobased content of 1-20, or 2-15, or 5-10, or 1-5, or 1-10, or 5-20 wt.%, based on total weight of the cleaning composition. Biobased content can be calculated according to ASTM D6866-16.

Method of Cleaning Substrates: To clean a surface or a substrate, the cleaning composition is brought into contact with the substrate for a sufficient amount of time to remove residue from the substrate. The residue (and the remaining cleaning composition) can be subsequently wiped off the surface. The sufficient amount of time in embodiments is of >3 sec., or >5 sec., or >10 sec., or >20 sec., or >30 sec., or >1 min., or >10 min, or <20 min., or <1 hr., for removing at least a portion, e.g., >5, >20, >40, >50, up to 90 wt.%, or almost all of the residue from the surface/substrate. In embodiments, the cleaning composition is heated to a temperature of 30-80, or 32-70, or 35-60, or >25, or <60° C., before use to facilitate the removal of the residue from the substrate.

In embodiments, the cleaning composition is applied onto the substrate to be cleaned by any of spraying, brushing, dipping, wiping, sprinkling, pouring, rolling, foaming, and the like. Alternatively, the cleaning composition can be impregnated into a sponge or a cloth and is used to remove and/or scrub the residue from the substrate.

For highly dirty substrates, the cleaning composition can be applied again and again if needed, depending on the amount of the residue to be removed/cleaned, the type of the DCR and type of the diluent used.

In embodiments, the cleaning composition softens or causes the residue to swell, or be dissolved into the cleaning composition, for subsequent removal, e.g., scrubbing or wiping away. In embodiments, the cleaning composition causes the residue to form a film or a skin to be subsequently peeled off.

In embodiments, the cleaning composition and the residue are removed from the substrate by any of blades, brushes, squeegees, pads, cloth, etc., to obtain a cleaned substrate.

In embodiments, an article, or a substrate to be cleaned is immersed in a bath containing the cleaning composition for the residue to be in contact with the cleaning composition for a sufficient amount of time, e.g., >1 min., for the residue to be dissolved or softened for subsequent removal.

Applications of Cleaning Composition: The cleaning composition can be used to remove residue from surfaces (substrates). Examples of residues include soil, dirt, sand, food, oil, grease, paint, ink, glue, adhesive, sealant, wax, tar, graffiti, asphalt, buffing compounds, cutting fluids, fat, sludge, and mixtures thereof. The substrate can be hard or soft, e.g., tiles, floor materials, glass, plastics, wood, metals, alloys, ceramic, epoxy, stone, veneer, laminates, etc.

The cleaning composition can be used in aqueous or non-aqueous systems. The cleaning composition can be made available as is, or used as a spray or a gel, or deposited onto a cleaning object such as a wet wipe, cleaning sheet, and the like; or with a dispenser or packaged as an aerosol, trigger spray, swab, etc., for any of ultrasonic cleaning equipment, vapor degreasing, or batch washer.

In embodiments, the cleaning composition is used as a wipe and applied or impregnated into a cleaning object, e.g., nonwoven fabric, woven fabric, felt, paper, sponge, cotton rag, sponge, cloth, and the like. In embodiments, an amount of the cleaning composition applied to the object or the object is impregnated with the cleaning composition, the amount is from 50-500, or 70-450, or 80-420, or 100-400, 120-370, or 150-350, or 180-320, or 200-300, or 10-100 or >100, or <450 wt.%, based on total weight of the object. In embodiments, if the cleaning composition itself is impregnated in the object, there is no need to perform further wiping or water rinsing after cleaning the substrate.

In embodiments, the cleaning composition is used to remove grease, oil, tar, asphalt, grime cutting fluids, handling soils, finger prints, dust, and other contamination common in assembly, stamping, other types of metal fabrication, refineries, motor repair, airplane hangars, clutches, armatures, generators, compressors, electrical motors and equipment, bearings, chains, cables, pulleys, gear drives, brakes, springs, medical clinic, medical facility, sporting arena, gymnasium, petroleum waste cleanup, and flywheel sand.

The cleaning composition can be used in household, industry, commercial facilities, factories, at locations, e.g., anodic, and electroplating treatment, cleaning vehicles, drilling fluid components from wellbore, wellbore clean out, solvent flooding, concrete, construction equipment, etc.

Examples: The following illustrative examples are non-limiting.

The following test methods are used.

Grease Removal by Immersing (or Water-Break Testing): Greased coupon after baking at 160° C. for 15 hrs., as mentioned above is immersed in the cleaning bath containing the cleaning composition for a certain period (e.g., 15 minutes), followed by taking the coupon out of the cleaning bath and rinsing with the diluent. The coupon is then placed in a vertical position and sprayed with DI water and observed as to the behavior of the water flow.

The following materials are used in the examples:

Residues: white lithium grease (marine grade), lithium complex grease, molybdenum disulfide grease, motor oil, and gear oil.

An industrial cleaner/degreaser: Simple Green from Sunshine Makers, Inc., d-limonene, methyl soyate, orange degreaser, and distilled water.

DCR samples are from Kraton Corporation with properties as shown in Table 1. The DCR samples also have the followings for DCR-I, DCR-II, and DCR-III respectively: % $O_2$ of 0.39 and 0.1, (no value for DCR-III); % tricyclic compounds of 69.5, and 77.7, (none for DCR-III); % aromatic MW 252 of 15.7, 14 and 12; reactive double bond MW 254 of 0.1, 0.5, and 4; aromatic MW 256 of 40.3, 45.3, and 29; reactive double bond MW 258 of 0.4, 0.8, and 1; cycloaliphatic MW 260 of 0.7, 0.3, and 10; cycloaliphatic MW 262 of 18.4, (none for DCR-II), and 8.

TABLE 1

Properties of DCRs

| Property | DCR-I | DCR-II | DCR-III |
|---|---|---|---|
| Acid Value (mg KOH/g) | 2.0 | 7.2 | 1.3 |
| Gardner Color | 1.0 | 10.5 | 5.6 |
| Kinematic Viscosity at 40° C. (cSt) | 21.26 | 47.59 | 31.83 |
| Kinematic Viscosity at 100° C. (cSt) | 3.14 | 4.68 | 3.70 |
| Viscosity Index | −125 | −136 | −199 |
| Pour Point (° C.) | −26 | −14 | −21 |
| Aniline Point (° C.) | 13 | — | 6 |
| Flash point (° C.) | 141° C. | 140° C. | — |
| Boiling point (° C.) | 235-360° C. | 235-360° C. | 235-360° C. |
| Dispersion forces (δD) | 15.7 | 16.4 | 15.8 |
| Polar interactions (δP) | 4.9 | 3.6 | 4.9 |
| Hydrogen bonds (δH) | 8.5 | 8.5 | 8.5 |
| Density at 20° C. (g/cm$^3$) | 0.9576 | 0.9630 | 0.9655 |
| Surface Tension (dynes/cm) | 34.02 | 34.46 | 34.35 |
| Sulfur content (wt. %) | <0.03 | <0.03 | — |

Example 1: Preparation of the cleaning composition: 5 wt.% of DCR-I, 5 wt.% of ethanolamine, and 5.5 wt.% of lauryl alcohol ethoxylate (6-8 mol% of ethoxylation of ethylene oxide) were combined into a glass beaker and stirred for 5 minutes at 100 RPM. 10 ml of DI water was added with interval of 2-3 minutes with continuous stirring at 100-400 RPM. Water was further added to make total addition of water to 84.5 wt.%. After addition of water, overall content was stirred to another 25 minutes and left overnight at 25° C.

Examples 2-5: Procedure of example 1 was repeated with other cleaning agents.

Examples 6-8: Cleaning agents in Table 2 were used as cleaning compositions.

TABLE 2

| Examples | Cleaning agent (in the cleaning composition) |
|---|---|
| Example-1 | DCR-I |
| Example-2 | DCR-II |
| Example-3 | DCR-III |

TABLE 2-continued

| Examples | Cleaning agent (in the cleaning composition) |
|---|---|
| Example-4 | D-Limonene |
| Example-5 | Methyl soyate |
| Example-6 | DI water |
| Example-7 | 1:10 (simple green:water) (diluted) |
| Example-8 | Orange degreaser |

Cleaning coupons by Scrub Test: A number of steel coupons were coated with white lithium grease, lithium complex grease, and molybdenum disulfide grease, then cleaning was performed by Scrub Test with different cleaning compositions of Examples 1 to 8. Photographs were taken to show performance of each cleaning composition after cleaning of coupons with 10, 20, or 120 cycles (1 cleaning cycle=wiping back and forth) and shown in FIG. 1.

In the figure, photographs 1*a* to 8*a* show coupons containing white lithium grease. Photographs 1*b* to 8*b* depict cleaning of white lithium grease (of 1*a*-8*a*) after 10 cycles with compositions of examples 1 to 8, respectively. Photographs 1*c* to 8*c* are coupons with lithium complex grease, and 1*d* to 8*d* are the respective coupons cleaned after 20 cycles, with Examples 1 to 8 compositions, respectively.

Photographs 1*e* to 5*e*, and 6*e* to 8*e* show coupons with molybdenum disulfide grease. Photographs if to 5*f* and 6*f* to 8*f* show cleaning of molybdenum disulfide grease from these coupons by using compositions of examples 1 to 8 after 120 cycles, respectively.

Table 3 represents removal of white lithium grease, lithium complex grease, and molybdenum disulfide grease from coupons in wt.% by using cleaning compositions of examples 1 to 8. The weight percentages were calculated by cleaning grease from each coupon with one cleaning cycle and averaging sample set of 3 coupons.

TABLE 3

| Examples | Removal of white lithium grease (wt. %) | Removal of lithium complex grease (wt.%) | Removal of molybdenum disulfide grease (wt.%) |
|---|---|---|---|
| Example-1 | 6 | 5 | 0.6 |
| Example-2 | 6 | 5 | 0.5 |
| Example-3 | 10 | 5 | 1.3 |
| Example-4 | 7 | 5 | 1 |
| Example-5 | 7 | 5 | 0.3 |
| Example-6 | 3 | 3 | — |
| Example-7 | 10 | 3 | 0.4 |
| Example-8 | 10 | 4 | 0.4 |

Cleaning of coupons by Water-Break test: Steel coupons were coated with gear oil, motor oil, and lithium complex grease. Cleaning of these coupons were performed using Water-Break tests by immersing coupons in different cleaning compositions (examples 1 to 8), either in a static cleaning composition bath or dynamic cleaning composition bath. In the static cleaning composition bath, the coupon was immersed in 250 ml jar filled with the cleaning composition and left for 15 minutes without disturbing. In case of the dynamic cleaning composition bath, the coupon was immersed in 250 ml jar filled with the cleaning composition and left for 15 minutes on a vibration shaker table (100 RPM) for 15 minutes. Coupons were removed from the static/dynamic cleaning composition baths for further testing. Results of cleaning of coupons by water-break test are summarized in table 4 in terms of rating scale defined as amounts of the residue left after cleaning the coupon with respective cleaning compositions.

TABLE 4

| | Gear oil | | Motor oil | | Lithium complex grease | |
|---|---|---|---|---|---|---|
| Examples | Static (Rating scale) | Dynamic (Rating scale) | Static (Rating scale) | Dynamic (Rating scale) | Static (Rating scale) | Dynamic (Rating scale) |
| Example 1 | 2 | 1 | 2 | 2 | 2 | 2 |
| Example 2 | 2 | 2 | 2 | 2 | 2 | 2 |
| Example 3 | 1 | 1 | 1 | 1 | 2 | 2 |
| Example 4 | 1 | 1 | 1 | 1 | 1 | 1 |
| Example 5 | 2 | 2 | 2 | 2 | 2 | 2 |
| Example 6 | 3 | 3 | 3 | 3 | 3 | 3 |
| Example 7 | 1 | 1 | 2 | 2 | 3 | 3 |
| Example 8 | 2 | 1 | 2 | 2 | 3 | 3 |

Rating scale as
1 = clean (<20 wt. % of the residue);
2 = moderate (>20 wt. % and <80 wt. % of the residue);
3 = heavy (>80 wt.% of the residue)

Example 9: Lithium complex grease was applied on a number of steel coupons. Table 5 shows average weight removal of lithium complex grease with different cleaning agents after 5 cleaning cycles (averaging cleaning 3 coupons).

TABLE 5

Lithium complex grease removal after 5 cleaning cycles.

| Cleaning agent | Lithium complex grease (Wt. % removed after 5 cleaning cycles) |
|---|---|
| DCR-I | 95.8 |
| D-Limonene | 83.6 |
| Methyl Soyate | 57.3 |
| DI Water | 30.3 |
| Mineral spirits | 17.8 |

As used herein, the term "comprising" means including elements or steps that are identified following that term, but any such elements or steps are not exhaustive, and an embodiment can include other elements or steps. Although the terms "comprising" and "including" have been used herein to describe various aspects, the terms "consisting essentially of" and "consisting of" can be used in place of "comprising" and "including" to provide for more specific aspects of the disclosure and are also disclosed.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

Unless otherwise specified, all technical and scientific terms used herein have the same meanings as commonly understood by one of skill in the art to which the disclosed disclosure belongs. The recitation of a genus of elements, materials, or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A method of cleaning a substrate to at least partially remove a residue from the substrate, comprising:

contacting at least a portion of the residue on the substrate with a cleaning composition, wherein the cleaning composition comprises:

(a) a decarboxylated rosin acid (DCR) having a density of 0.9 to 1.0 g/cm$^3$, a flash point of 135 to 175° C., an acid value of <50 mg KOH/g, measured according to ASTM D465, and a viscosity of 15 to 60 cSt at 40° C., measured according to ASTM D-445; and (b) optionally a diluent;

removing at least a portion of the cleaning composition along with at least a portion of the residue from the substrate;

wherein the residue is selected from the group consisting of soil, dirt, sand, food, oil, grease, paint, ink, glue, adhesive, sealant, wax, tar, graffiti, asphalt, buffing compounds, cutting fluids, fat, sludge, and mixtures thereof;

wherein at least 0.3 wt.% of the residue is removed from the substrate per cleaning cycle, based on total weight of the residue present on the substrate, measured as described in a Scrub Test.

2. The method of claim 1, wherein the DCR comprises: one or more C=C groups; and 40 to 100 wt.% of tricyclic compounds having 18 to 20 carbon atoms.

3. The method of claim 2, wherein sum of tricyclic compounds as aromatic and cycloaliphatic in the DCR is >50 wt.%, based on total weight of the DCR.

4. The method of claim 2, wherein the DCR comprises tricyclic cycloaliphatic compounds in an amount of >15 wt.%, based on total weight of the DCR.

5. The method of claim 1, wherein the DCR has at least one of: a density of 0.92 to 0.98 g/cm$^3$; an acid value of 0.4 to 40 mg KOH/g; and a flash point of 140 to 175° C.

6. The Method of claim 1, wherein the DCR has a viscosity of 20 to 50 cSt at 40° C., measured according to ASTM D-445.

7. The method of claim 1, wherein the DCR has at least one of: an aniline point of 3 to 40° C., measured according to ASTM D611; a pour point of −40 to +10° C., measured according to ASTM D97; and a boiling point of 200 to 390 ° C., measured according to D2887.

8. The method of claim 1, wherein the DCR has at least one of: a Gardner Color of 0 to 12.0, measured according to ASTM D6166; and a sulfur content of <0.05 wt.%, based on total weight of the DCR, measured according to ASTM D5453.

9. The method of claim 1, wherein the DCR has at least one of: a volatile organic content (VOC) of <5 wt.%, based on total weight of the DCR; and a Kauri butanol (Kb) value of 25 to 90, measured according to ASTM D1133.

10. The method of claim 1, wherein the DCR has a surface tension of 25 to 50 dynes/cm, measured according to ASTM D1331.

11. The method of claim 1, wherein 0.5 to 20 wt.% of the residue is removed from the substrate per cleaning cycle, based on total weight of the residue present on the substrate.

12. The method of claim 1, wherein the cleaning composition comprises: 1 to 20 wt.% of the DCR; and 80 to 99 wt.% of the diluent, based on total weight of the cleaning composition.

13. The method of claim 1, wherein the cleaning composition is in the form of suspension, dispersion, emulsion, solution, or sol.

14. The method of claim 1, wherein the cleaning composition has a biobased carbon content of 1-20 wt.%, based on total weight of the cleaning composition.

15. The method of claim 1, wherein the cleaning composition has a pH in the range of 9 to 13.

16. The method of claim 1, wherein the diluent is selected from the group consisting of water, aliphatic hydrocarbons, aromatic hydrocarbons, alcohols, natural oil solvents, fats and oils, fatty acids, glycerin, and mixtures thereof.

17. The method of claim 1, wherein the cleaning composition further comprises at least one additive selected from the group consisting of surfactants, stabilizers, rheology modifiers, biocides, preservatives, corrosion inhibitors, metal deactivators, deodorants, antioxidants, dyes, colorants, pigments, wetting agents, viscosifiers, polymers, fillers, antistatic agents, flow-promoting agents, processing aids, pH control agents, builders, fragrance, essential oils, buffer systems, abrasive powder, anti-microbial agents, anti-redeposition agents, water softeners, borax, emollients, digestive enzymes, enzyme stabilizers, boosters, detectable components for assessing the cleaning of the substrate, scrubbing agents, and mixtures thereof;

and wherein the additive is added in an amount of 0.5-15 wt.%, based on total weight of the cleaning composition.

18. The method of claim 17, wherein the surfactant is at least one selected from the group consisting of anionic, cationic, non-ionic, amphoteric surfactants, and mixtures thereof.

19. The method of claim 1, wherein:

contacting at least a portion of the residue on the substrate with the cleaning composition comprises immersing at least a portion of the substrate containing the residue in a cleaning bath containing the cleaning composition; and removing at least a portion of the cleaning composition along with at least a portion of the residue from the substrate comprises:

withdrawing the substrate from the cleaning bath; and rinsing the substrate with a diluent to remove at least a portion of the residue from the substrate.

20. The method of claim 1, wherein:

contacting at least a portion of the residue on the substrate with the cleaning composition comprises impregnating a cleaning object with the cleaning composition and contacting at least a portion of the cleaning object containing the cleaning composition with at least a portion of the residue on the substrate; and removing at least a portion of the cleaning composition along with at least a portion of the residue from the substrate comprises wiping the substrate with the cleaning object to remove at least a portion of the residue from the substrate.

* * * * *